United States Patent [19]

Vorderer

[11] Patent Number: 4,843,737

[45] Date of Patent: Jul. 4, 1989

[54] ENERGY RETURN SPRING SHOE CONSTRUCTION

[76] Inventor: Thomas W. Vorderer, 28 Academy St., Braintree, Mass. 02184

[21] Appl. No.: 107,803

[22] Filed: Oct. 13, 1987

[51] Int. Cl.[4] ..... A43B 21/30

[52] U.S. Cl. ..... 36/38; 36/27

[58] Field of Search ..... 36/38, 37, 27, 35 R, 36/35 B, 7.8, 28, 114, 129

[56] References Cited

U.S. PATENT DOCUMENTS

| | | | |
|---|---|---|---|
| 4,342,158 | 8/1982 | McMahon et al. | 36/38 X |
| 4,391,048 | 7/1983 | Lutz | 36/35 R |
| 4,492,374 | 1/1985 | Lekhtman et al. | 36/7.8 X |
| 4,638,575 | 1/1987 | Illustrato | 36/38 |
| 4,771,554 | 9/1988 | Hannemann | 36/38 X |

FOREIGN PATENT DOCUMENTS

| | | | |
|---|---|---|---|
| 3506055 | 8/1986 | Fed. Rep. of Germany | 36/28 |
| 472837 | 8/1914 | France | 36/7.8 |
| 2577119 | 8/1986 | France | 36/27 |

*Primary Examiner*—James Kee Chi

*Attorney, Agent, or Firm*—John P. McGonagle

[57] ABSTRACT

An article of footwear with a spring device positioned in the heel portion of the article's midsole. The device is comprised of two, horizontal, rectangular, semi-elliptical shaped plates, with outwardly curving surfaces facing, joined at either end and having a plurality of springs positioned between the plates and joined to the plates at either end of the plates.

19 Claims, 5 Drawing Sheets

ENERGY RETURN SPRING SHOE CONSTRUCTION

BACKGROUND OF THE INVENTION

This invention relates to footwear, and more particularly to a new and improved spring heel sole construction that is especially advantageous in running shoes.

Running shoes today deal primarily with shock absorption. In the manufacture of shoes, many arrangements have been used or suggested to dissipate the energy at heel strike in the gait cycle. The energy generated by the foot striking the ground is dissipated either through the midsole of the shoe into the foot and leg of the athlete or as heat by conventional resilient cushioning materials after energy absorption. Although shock is absorbed, the runner loses a significant portion of his or her kinetic energy every time his or her foot strikes the ground.

Accordingly, it is an object of the present invention to provide a shoe construction which transiently stores and returns energy to the runner, as well as provide shock absorption. By the shoe returning energy to the wearer, the wearer will expend less energy during his or her activity. Improved shock absorption is provided due to the dynamic nature of the shoe constrution which causes it to adjust according to the load imposed upon it.

SUMMARY OF THE INVENTION

The invention consists of a spring device positioned in the heel portion of the shoe's midsole. The spring device is comprised of two, horizontal, rectangular, elliptically-shaped plates, with outwardly curving surfaces facing, joined at either end by a locking arrangement, having a spring or springs or a band of elastic-type material positioned between the plates and joined to the plates at either end of the plates. Where springs are used between the plates, simple coil springs may be used with either end joined to the ends of the plates.

The plates and springs may be constructed of various polymer materials and/or metals to accommodate the various activities which a particular shoe may be used for. Heavier and/or denser materials would be used for an activity such as basketball where the kinetic energy expended by the shoe wearer is primarily in a vertical direction. Lighter materials would be used for an activity such as road racing where the kinetic energy expended has a substantial forward direction.

The width of the spring device fits generally the width of the midsole. The plates' longitudinal axis is defined by the plate ends forward and rearward. The plates' longitudinal axis is coincident with the longitudinal axis of the midsole. Midsole material and/or air bladders may be added between the plates for protection of the spring device and for added shoe stability.

DETAILED DESCRIPTION OF THE PREFERRED EMBODIMENT

Figure 1:
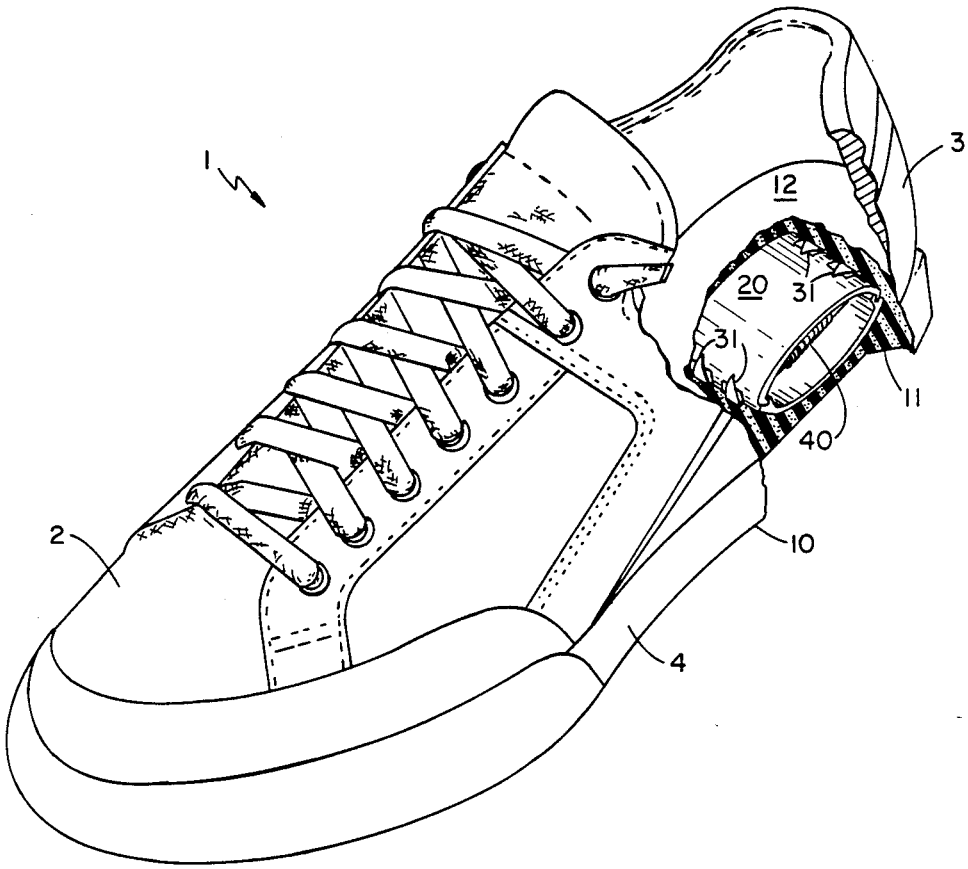
FIG. 1 is a perspective view with portions broken away of a running shoe constructed according to the invention.

Referring now to the drawings in detail wherein like numerals indicate like elements, reference numeral 1 refers generally to an article of footwear having the outer appearance of a running shoe, sneaker, or the like, and comprised of an upper portion 2, a heel counter 3, and a bottom portion 4. The upper portion 2 and the heel counter 3 may be fabricated from a variety of different materials commonly used in footwear and may be from various types of fabric as well as leather, both real and artificial, plastics and combinations thereof.

The bottom portion 4 is comprised of an outer sole 10, a mid sole 11, and a layer 12. The mid sole 11 and layer 12 are made of a soft material such as felt, foam or similar shoe material. The outer sole 10 is made of a relatively tough, long wearing, resilient material such as rubber or other elastomeric material, and generally provides a tread surface for the shoe.

When constructing the shoe 1 according to the present invention, a spring device 20 is placed in the mid sole 11 of the shoe 1. In the case of an athletic shoe the spring device 20 is generally positioned below the area of the heel counter 3. The device 20 is comprised of two, horizontal, rectangular, semi-elliptical plates 21 and 22 with one or more springs 40 or bands of elastic-type material in parallel positioned between the plates 21 and 22 and joined together with the plates 21 and 22 at either end 41. The ends 23 of the upper plate 21 are formed into a plurality of flanges 25 projecting downwardly at an approximate right angle. Near to the ends 24 of the lower plate 22 are upwardly projecting right angle hooks 26 for receiving and engaging the upper plate flanges 25. The lower plate ends 24 have notches 27 corresponding to gaps 28 between the upper plate flanges 25. The longitudinal axis of the plates 21 and 22 extend from end 23, 24 to end 23, 24, and are coincident with the longitudinal axis of the shoe 1. The width of the plates 21 and 22 corresponds generally to the width of the mid sole 11. The outwardly curving faces 29 and 30 of the plates 21 and 22 face one another. When the upper plate 21 is joined to the lower plate 22 by means of the flanges 25 engaging the lower plate hooks 26, the lower plate ends 24 are then bent upwardly, thereby holding the upper plate flanges 25 in position against the lower plate hooks 26.

Figure 2:
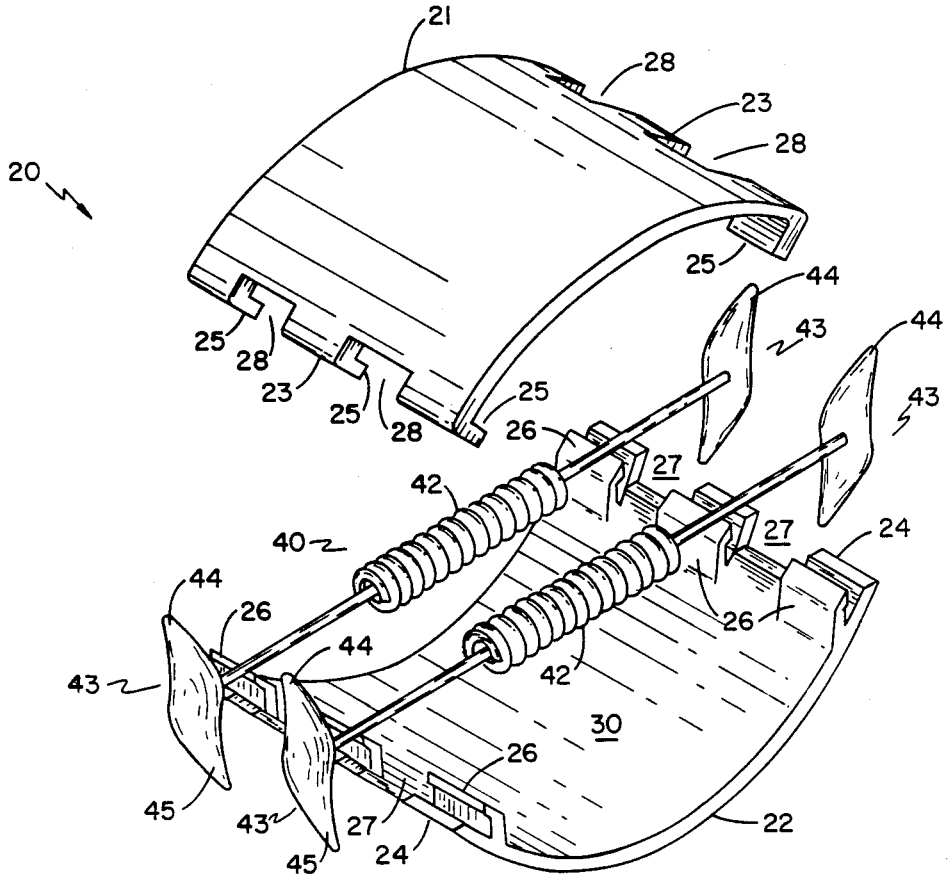
FIG. 2 is an exploded perspective view of the spring device before construction.
Figure 3:
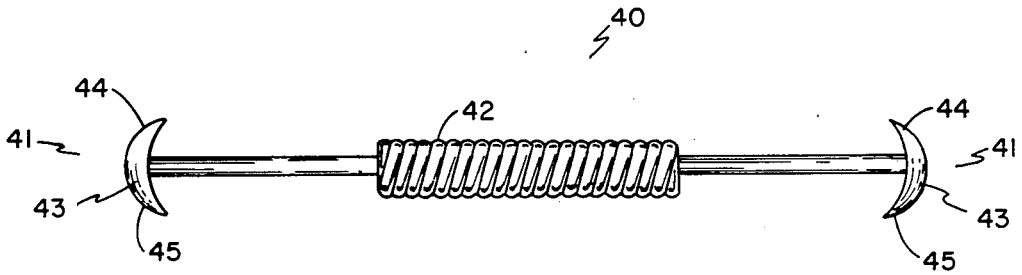
FIG. 3 is a sectional elevational view of one end of the spring after construction.
Figure 4:
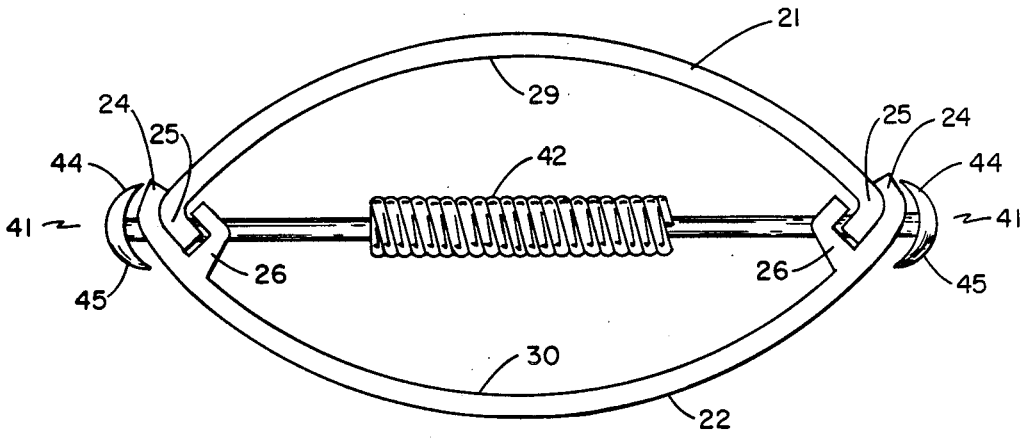
FIG. 4 is a side elevational view of the spring device assembled.

Positioned between the outwardly curving faces 29 and 30 of the plates 21 and 22 are one or more springs 40 or bands. In this embodiment of the invention simple coil spring elements 42 are used. The ends 41 of the spring elements 42 are formed into double latches 43. Before placement between the plates 21 and 22 (FIG. 2), the superior latch 44 of each end 41 is open, and the inferior latch 45 is closed. This allows the spring 40 to be inserted through the openings 31 formed by the plates' notches 27 and gaps 28. The inferior latch 45 immediately grasps the lower plate 22 through the notches 27 formed at the lower plate ends 24. The superior latches 44 are then bent back over the upper plate ends 23 in the gaps 28 between flanges 25.

Figure 5:
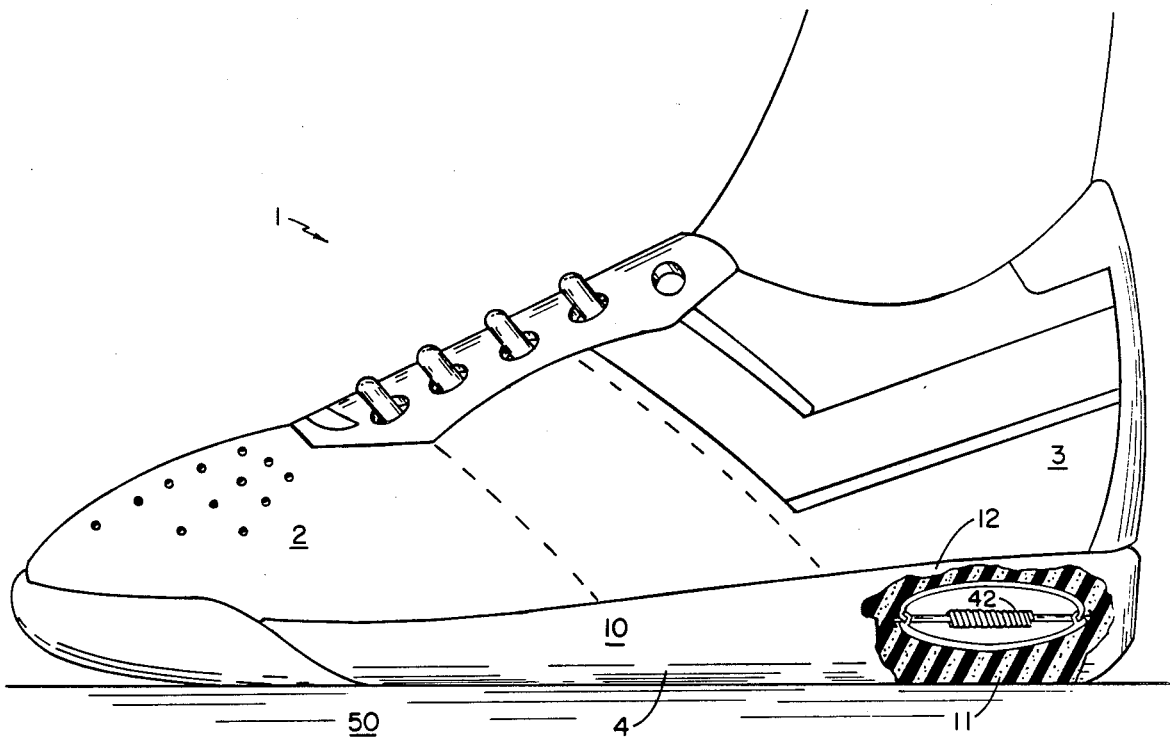
FIG. 5 is a sectional view in side elevation of a running shoe constructed according to the invention in the swing phase of the wearer's gait.
Figure 6:
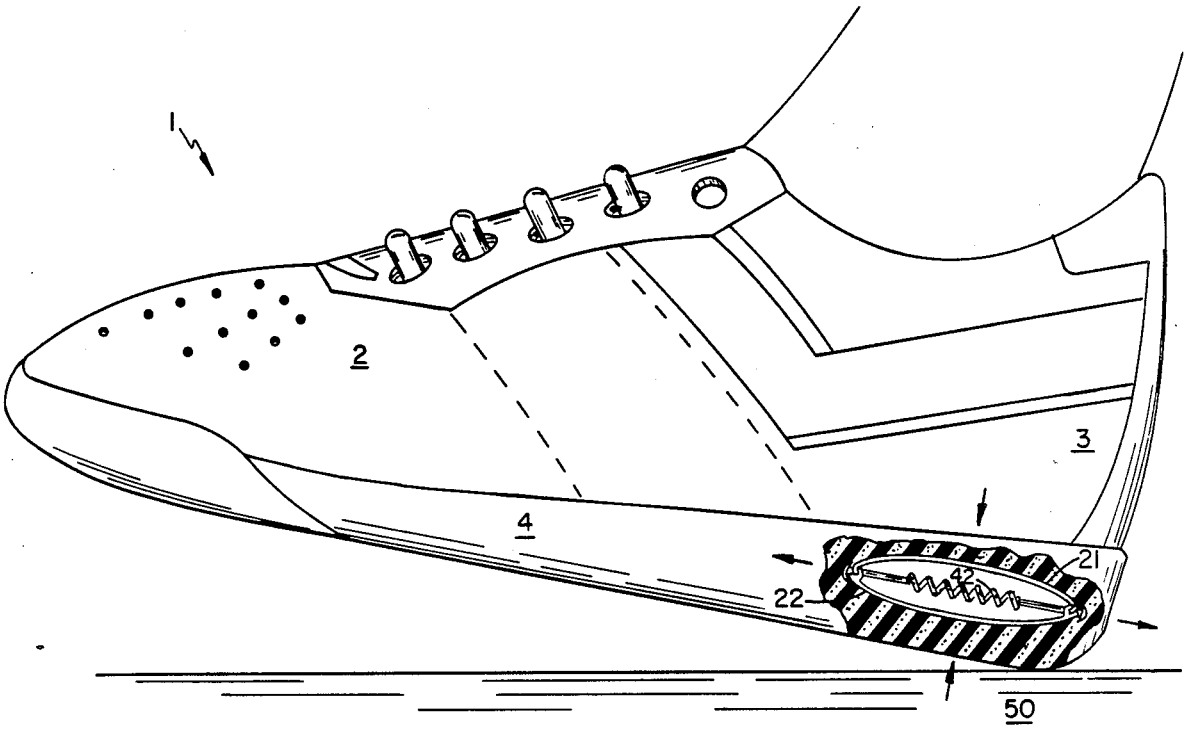
FIG. 6 is a sectional view in side elevation of a running shoe constructed according to the invention in the heel strike phase of the wearer's gait.
Figure 7:
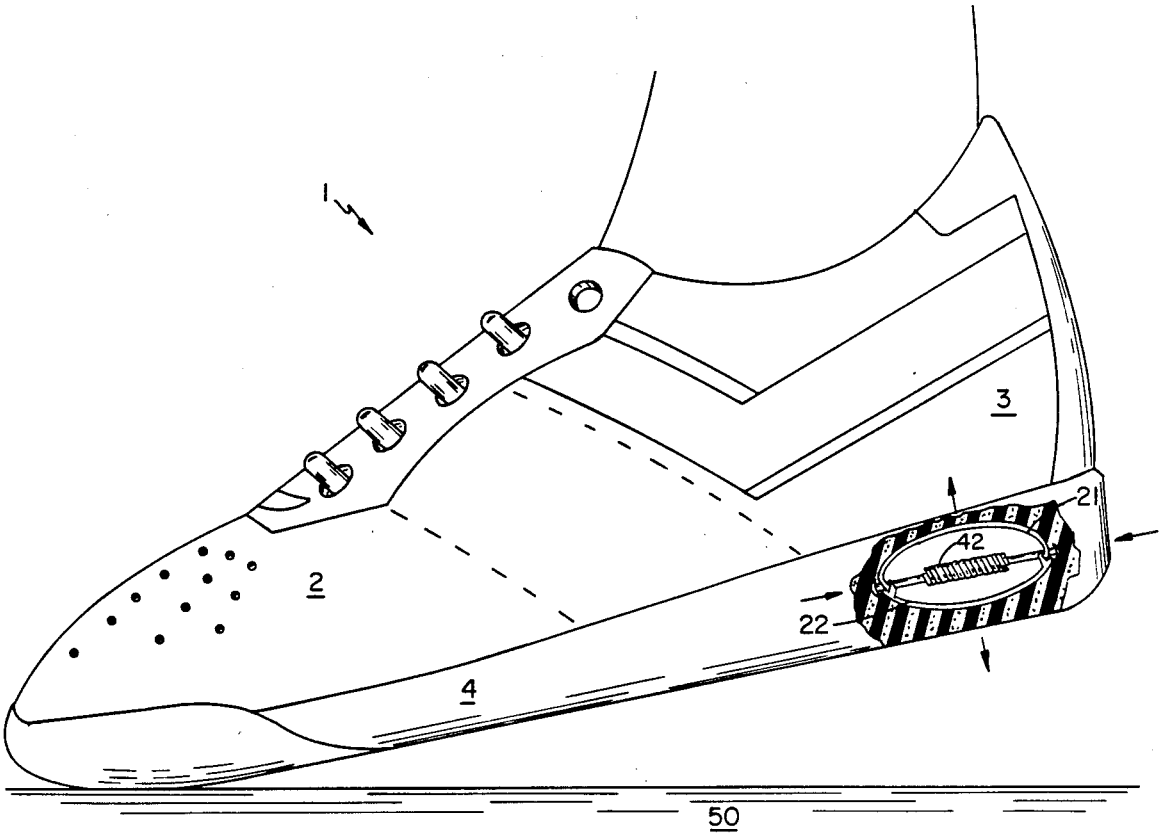
FIG. 7 is a sectional view in side elevation of a running shoe constructed according to the invention in the toe off phase of the wearer's gait.
Figure 8:
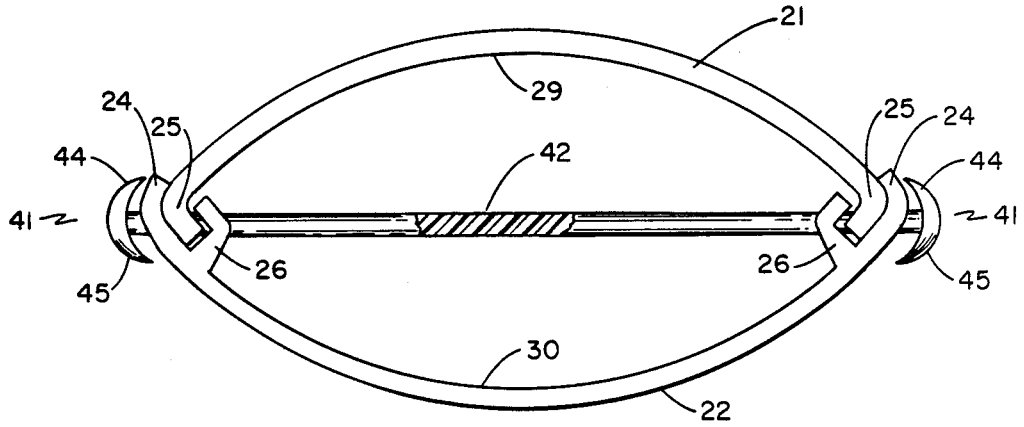

In operation the two plates 21 and 22 are acted upon at heel strike by the force of the wearer's kinetic energy (FIG. 6). The force at heel strike will cause the plates 21 and 22 to compress between the downward force of the wearer and the immovable force of the ground 50. The plate 21 and 22 will tend to flatten and thereby lengthen along their longitudinal axis. This in turn will cause the spring elements 42 to stretch. The heel strike force is thereby absorbed. Once pressure is taken off the plates 21 and 22 as the body weight of the shoe wearer is moved forward on the foot in midstance and toe off phases of the wearer's gait, the spring element 42 will begin contracting and the plates 21 and 22 shortening along their longitudinal aixs, thereby releasing energy stored in the spring elements 42 and plates 21 and 22 back to the shoe wearer and aiding in the wearer's forward momentum (FIG. 7). While the wearer is in mid stride, the spring device 20 will be at rest (FIG. 5).

The plates 21 and 22 may vary in weight and/or density to permit different shock absorption properties based on the sport or activity involved, and/or the possible weight of the wearer or size of the shoe. In the preferred embodiment, the springs 40 are molded polymer springs. Various materials and densities based on the same considerations as for the plates 21 and 22 may also be used. The spring device 40 may also be imbedded in felt, foam or similar shoe material to add life and prevent collapse.

It is understood that the above-described embodiment is merely illustrative of the application. Other embodiments, therefore, may be readily devised by those skilled in the art which will embody the principles of the invention and fall within the spirit and scope thereof.

I claim:

1. An article of footwear constructed to transiently store and return energy to a wearer as well as provide shock absorption, comprising:

an upper portion;

a bottom portion having a mid sole and connected to said upper portion; and a spring device positioned within said mid sole, said spring device being comprised of two horizontal, rectangular, semi-elliptical plates, with outwardly curving surfaces facing, connected to each other at each plate's forward and rearward ends, and having a plurality of springs positioned between said plates and joined to said plates at said plates' forward and rearward ends.

2. An article of footwear as recited in claim 1, wherein:

the said plates' longitudinal axis is defined by the plates' forward and rearward ends and whose longitudinal axis is coincident with the longitudinal axis of the article of footwear.

3. An article of footwear as recited in claim 2, wherein:

the width of said plates corresponds generally to the width of said mid sole.

4. An article of footwear as recited in claim 3, wherein:

said upper portion contains a heel counter portion.

5. An article of footwear as recited in claim 4, wherein:

said spring device is generally positioned below the area of said heel counter.

6. An article of footwear as recited in claim 5, wherein:

said spring device is enclosed in mid sole material to give support to said device and stability to the article of footwear.

7. An article of footwear as recited in claim 6, wherein:

said spring device absorbs shock and transiently stores energy by compression of said plates and lengthening of said spring elements during the heel strike portion of the wearer's gait.

8. An article of footwear as recited in claim 7, wherein:

said spring device returns energy to a wearer by contraction of said spring elements and decompression of said plates as the wearer's body weight is moved forward on the wearer's foot in mid stance and toe off phases of the wearer's gait.

9. An article of footwear as recited in claim 8, wherein:

said plates and spring elements may be constructed of various polymer materials and/or metals to accommodate the various activities which a particular article of footwear may be used for, or to accommodate different weights or sizes of the wearer.

10. An article of footwear as recited in claim 9, wherein:

said spring elements are coil springs in a parallel arrangement.

11. An article of footwear constructed to transiently store and return energy to a wearer as well as provide shock absorption comprising:

an upper portion;

a bottom portion having a mid sole and connected to said upper portion; and a spring device positioned within said mid sole, said spring device being comprised of two horizontal, rectangular, semi-elliptical shaped plates, with outwardly curving surfaces facing, connected to each other at each plate's forward and rearward end, and having a plurality of bands made from an elastic-type material, positioned between said plates and joined to said plates at said plate's forward and rearward ends.

12. An article of footwear as recited in claim 11, wherein:

the said plates' longitudinal axis is defined by the plates' forward and rearward ends and whose longitudinal axis is coincident with the longitudinal axis of the article of footwear.

13. An article of footwear as recited in claim 12, wherein:

the width of said plates corresponds generally to the width of said mid sole.

14. An article of footwear as recited in claim 13, wherein:

said upper portion contains a heel counter portion.

15. An article of footwear as recited in claim 14, wherein:

said spring device is generally positioned below the area of said heel counter.

16. An article of footwear as recited in claim 15, wherein:

said spring device is enclosed in mid sole material to give support to said device and stability to the article of footwear.

17. An article of footwear as recited in claim 16, wherein:

said spring device absorbs shock and transiently stores energy by compression of said plates and lengthening of said bands during the heel strike portion of the wearer's gait.

18. An article of footwear as recited in claim 17, wherein:

said spring device returns energy to a wearer by contraction of said bands and compression of said plates as the wearer's foot in midstance and toe off phases of the wearer's gait.

19. An article of footwear as recited in claim 18, wherein:

said plates may be constructed of various polymer materials and/or metals to accommodate the various activities which a particular article of footwear may be used for, or to accommodate different weights or sizes of the wearer.

* * * * *